United States Patent [19]

Zachery

[11] 4,010,611

[45] Mar. 8, 1977

[54] COMPRESSION-EXPANSION POWER DEVICE

[76] Inventor: James E. Zachery, P.O. Box 116, Corrales, N. Mex. 87048

[22] Filed: Dec. 17, 1974

[21] Appl. No.: 533,539

[52] U.S. Cl. ..... 60/516; 92/66; 92/75; 123/51 AA; 123/51 BA; 123/51 A

[51] Int. Cl.[2] ..... F01B 7/02

[58] Field of Search ..... 92/50, 66, 69, 75; 60/516, 517; 123/51 AA, 51 BA, 51 A

[56] References Cited

UNITED STATES PATENTS

| | | | |
|---|---|---|---|
| 1,590,940 | 6/1926 | Hallet | 123/51 AA |
| 2,486,185 | 10/1949 | Mallory | 123/51 BA |
| 2,494,890 | 1/1950 | Mallory | 123/51 BA |

*Primary Examiner*—Allen M. Ostrager
*Attorney, Agent, or Firm*—Clarence A. O'Brien; Harvey B. Jacobson

[57] ABSTRACT

A power device or mechanism embodying cyclic compression and expansion of compressible fluids, such as various gases, in a unique manner hereinafter referred to as the "Zachery" cycle. The power device, as disclosed, includes a chamber, such as a cylinder, and movable components, such as opposed pistons, associated with the chamber for varying the volume of the chamber and varying the pressure of gases therein with the movable components being mechanically connected to crankshafts or other mechanisms to enable the highest pressures obtained during the compression-expansion cycle to occur at or near the maximum lever arm of a crankshaft or other mechanism thereby generating the maximum torque possible from the gas pressure available. The power device also exerts its maximum force when the pressure within the chamber is at a maximum. The movable components, such as the opposed pistons, utilize a common space within the chamber with the cyclic movement of the movable components having a substantial overlap of movement with the overlapping portions of the cycles of movement of each of the movable components being at different intervals in the compression-expansion cycle thereby enabling a substantial increase in thermal efficiency as compared to other variable volume devices.

5 Claims, 15 Drawing Figures

COMPRESSION-EXPANSION POWER DEVICE

BACKGROUND OF THE INVENTION

1. Field of the Invention

The present invention generally relates to a compression-expansion power device or mechanism preferably, but not necessarily, in the form of a cylinder with opposed pistons mounted therein and connected to opposed crankshafts for reciprocation of the pistons in relation to each other and in relation to the cylinder for compressing and expanding gases in accordance with the "Zachery" cycle with the device being arranged for generating the maximum torque possible from the gas pressure available and yielding a substantial increase in thermal efficiency as compared to other variable volume devices.

2. Description of the Prior Art

The thrust of new designs in energy conversion devices has generally centered on means of increasing thermal efficiency and thereby decrease fuel consumption for a given work ouput. Improvements in thermal efficiency of internal combustion engines operating on the Otto cycle or Diesel cycle have in the past been largely directed at improving the preignition and burning characteristics of fuels since it has long been known that increasing the compression ratio of such engines will increase their thermal efficiency. Engines that require super-charging by virtue of their design such as two cycle engines and U.S. Pat. No. 2,486,185 cited below, wherein exhaust gases are expelled through exhaust ports by inlet air under pressure, have directed their improvements at decreasing fuel losses through the exhaust ports during the scavenging process and the thermal efficiency losses inherent in supercharging are accepted as part of the nature of the design. Supercharging of spark ignition engines has virtually been abandoned, except for special applications where fuel economy is not of prime importance, because of the drastic reduction in thermal efficiency resulting from the decrease in compression ratio required in order to avoid preignition of the fuel. Improvements in overall thermal efficiency of internal combustion engines have also been made by using exhaust turbines to further expand exhaust gases prior to release to the atmosphere.

Power devices in the form of opposed piston engines using the Otto cycle and Diesel cycle have been known for many years and some embodiments of these engines have been in use. Such devices normally employ opposed pistons which reciprocate at the same frequency with ignition of the combustible mixture occuring near the point of highest pressure and lowest volume between the pistons which occurs when the two pistons simultaneously reach their innermost point of cyclic movement or near top dead center. Such devices theoretically afford no increase in thermal efficiency as compared to non-opposed similar engines.

In addition to this type engine, the following list of patents is exemplary of developments which have occurred in this type of structure in which one piston travels at a different rate of speed than the other and the pistons are out-of-phase so that the overlapping portions of the path of movement of the pistons will occur at different intervals of the cycle of movement of each piston.

| | |
|---|---|
| 670,966 | Apr. 2, 1901 |
| 1,168,877 | Jan. 18, 1916 |
| 1,237,696 | Aug. 21, 1917 |
| 1,689,419 | Oct. 30, 1928 |
| 2,160,687 | May 30, 1939 |
| 2,345,056 | Mar. 28, 1944 |
| 2,473,759 | June 21, 1949 |
| 2,486,185 | Oct. 25, 1949 |
| 3,485,221 | Dec. 23, 1969 |

It appears that of the above patents none are exemplary of the necessary arrangements of their commonly known parts that will theoretically or practicably achieve a significant increase in thermal efficiency over that obtainable from a standard Otto cycle or Diesel cycle engine.

Of the above listed patents, Mallory, U.S. Pat. No. 2,486,185 discloses an engine having a cylinder with opposed pistons mounted therein and connected to crankshafts at each end of the cylinder with one of the crankshafts being connected to the other so that the two crankshafts have a turning ratio of 2:1 with the angular orientation of the crankshafts and, the pistons attached thereto, being such that when the slow speed piston is at its inner dead center, the fast speed piston is approximately 90° advanced past its outer dead center position, which arrangement accomplishes the purpose of controlling an exhaust port by the slow speed piston. The cylinder includes an exhaust port that begins to become uncovered by the slow speed piston when it has moved approximately 125° from inner dead center. The cylinder is also provided with a centrally located port and chamber with air and fuel admission to the chamber controlled by valves such that an air charge is admitted to the cylinder starting at approximately the time of first uncovering of the exhaust port and continuing until the slow speed piston has almost recovered the exhaust port at which time the fuel valve is opened and air and fuel intake continue until the largest intake volume is achieved at which time the air and fuel valves are closed and the compression stroke begins. This arrangement allows for the complete exhaust of the burnt gases before fuel is introduced providing sufficient supercharging is used. Mallory states that inlet air under pressure is essential for operation in the stroke configuration of FIG. 8 of U.S. Pat. No. 2,486,185. It is evident that this configuration will not operate without supercharging since the volume decreases after the slow speed piston closes the exhaust port and no fresh air can be taken in leaving the chamber and cylinder volume completely filled with burnt gases at the beginning of the compression stroke. As a result of the arrangement of the intake port, the piston controlled exhaust port and the phase relationship between the pistons and the crankshafts, the storke ratio configurations of FIGS. 7 and 9 of U.S. Pat. Nos. 2,486,185 leave residual burnt gas volumes of about 65% and 35% respectively of the total possible intake volume remaining when the exhaust port is closed by the slow speed piston and it is probable that the Mallory engine in these stroke ratio configurations would also have to be supercharged in order to be operative. In U.S. Pat. No. 2,486,185 the midpoint displacement of both pistons occurs at 90° and 270° and the midpoint displacement of the fast speed piston also occurs at 0° and 180° which phase relationship results in the overlap or commonly used space in the cylinder being very minimal; approximately 5% of the stoke for the configuration of FIG. 7, approximately 3% of the stroke for FIG. 8 and less than 0% or no commonly used space for FIG. 9 if a clearance of 25 one hundredths inches is retained at the point of closest approach. Moreover, in U.S. Pat. No. 2,486,185 the maximum lever arm of the slow speed crankshaft occurs approximately 42° beyond the point of least volume at which point the gas has expanded to approximately 50% of the final expansion volume and the pressure is greatly reduced.

SUMMARY OF THE INVENTION

An object of the present invention is to provide a compression-expansion power device or mechanism utilizing the "Zachery" cycle exemplified by the use of two opposed pistons reciprocating in a common cylinder and sequentially utilizing a substantial common space within the cylinder which will allow an initial volume of gas to be compressed to any desired compression ratio ($V_1/V_2$) and then expanded to any desired expansion ratio ($V_4/V_2$) in a repetitive cycle providing that one piston is reciprocated at twice the frequency of the other piston and providing that the phasing and displacement of the reciprocating pistons and related crankshafts are such that mechanical interference between the piston faces does not occur in the common space utilized. The desired compression ratio and expansion ratio may be determined by selecting proper phase relationships of the components, stroke lengths and center displacement of the reciprocating pistons and related mechanisms with such selection including the possibility of the use of variable stroke, variable phase or variable center reciprocating mechanisms with the frequency of reciprocation of the pistons being fixed or varied as long as the frequency of reciprocation of one piston is maintained at twice the frequency of reciprocation of the other pistons.

A further object of the invention is to provide an alternate construction to that described in the preceding paragraph wherein one reciprocating piston operates within one reciprocating closed cylinder with either the piston or the cylinder reciprocating at twice the frequency of the other and any other alternative construction employing the principles of the cycle disclosed herein is also contemplated in this invention.

A further object of the invention is to provide a power device in accordance with the preceding objects in which access to the cylinder or chamber volume may be by any conventional or suitable valving and/or porting method or mechanism or any combination or variation thereof which permits entry and exit of gases or compressible fluids and ignition thereof where combustible mixtures are employed in an internal combustion engine. Such access may be varied depending upon the purposes for which the device is to be used with an internal combustion engine employing one type of access facilities while other types of engines, air-driven motors or the like may take another type of access with compressors, refrigerators, generators, pumps and the like requiring different types of access to the cylinder or chamber volume.

Another object of the invention is to provide a device in accordance with the preceding objects in which an initial volume of gas or compressible fluid is heated and/or cooled through conduction, convection or radiation through or in the cylinder or piston walls such that entry and exit access to the volume during operation may be used but is not required. The thermal efficiency of one such air standard Zachery cycle where heat is injected at constant volume and heat is rejected at constant pressure is given by:

$$1 - K\left(\frac{R_x - R_c}{R_x^k - R_c^k}\right)$$

Where $R_x$ is expansion ratio, $R_c$ is compression ratio, K is constant over the cycle, and the pressure at the beginning of compression is equal to the pressure at the end of expansion. Expressions for other Zachery cycles wherein heat is added and rejected at constant pressure, or wherein heat is added and rejected at constant volume may readily be derived.

In a practical embodiment of the "Zachery" cycle, an internal combustion engine is provided incorporating two crankshafts of equal throw connected by a chain and sprocket assembly with the crankshafts being connected to pistons in a common cylinder with the crankshafts having a 2:1 ratio phased so that when one piston is at its maximum pentration into the common cylinder, the other piston is at its minimum penetration which position is designated as 0° for each piston with the movement of the two pistons being cyclic in the manner of the "Zachery" cycle which provides maximum thermal efficiency and maximum torque exerted on one crankshaft at the highest pressure in the cylinder.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
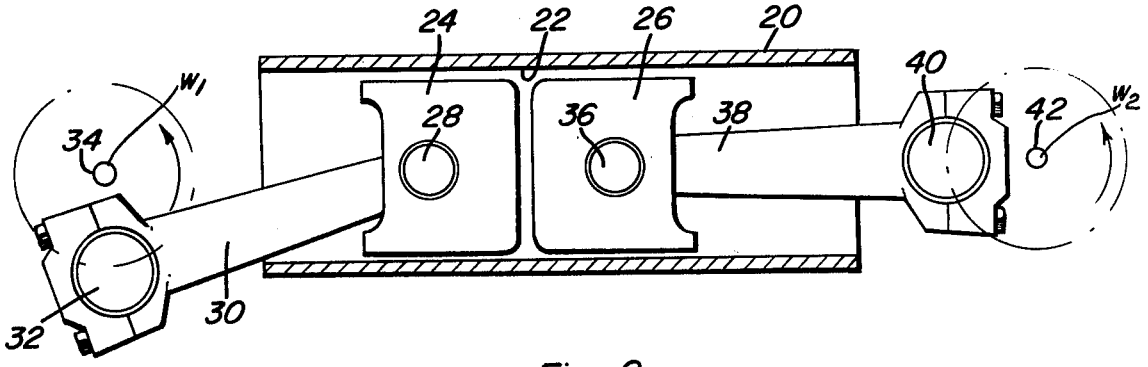
FIGS. 1–3 schematically illustrate a cylinder and two opposed pistons and crankshafts illustrating the nominal relationship of the angular position of the two crankshafts and the position of the pistons during rotation thereof.
Figure 2:
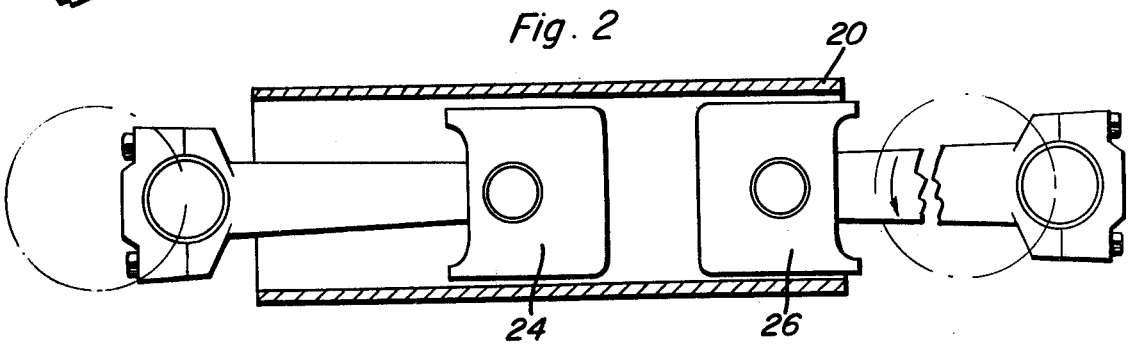
Figure 3:
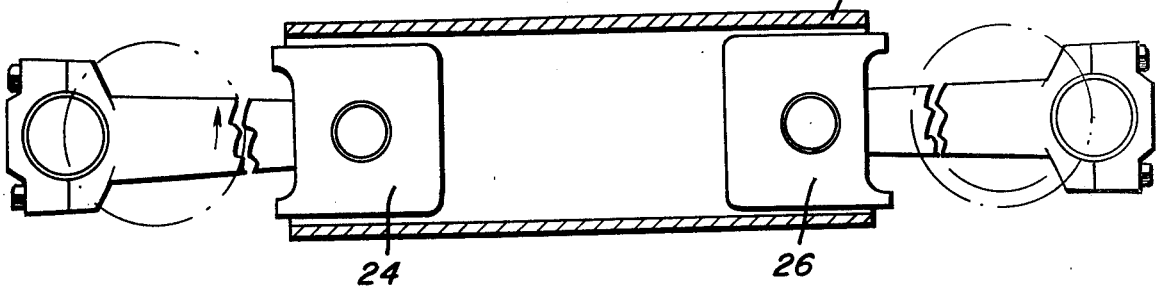
Figure 4:
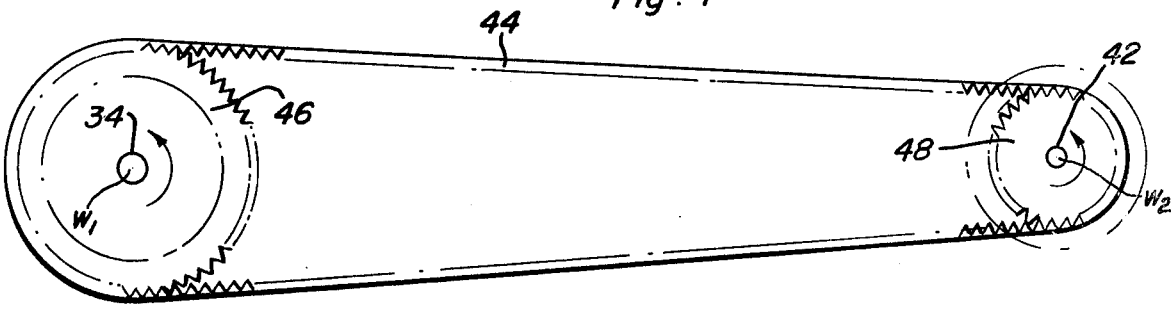
FIG. 4 is a schematic illustration of a chain and sprocket interconnection between the crankshafts to maintain the rotational relationship between the crankshafts.

The present invention is schematically illustrated as including a cylinder 20 which is open-ended and defines an internal chamber 22 receiving opposed pistons 24 and 26 therein which reciprocate from an inner or top dead center to an outer or bottom dead center with the piston 24 including a wrist pin 28, connecting rod 30 connected to a crank throw 32 which forms part of a crankshaft 34. The piston 26 includes the same construction of a wrist pin 36, connecting rod 38, crank throw 40 and crankshaft 42 with both of the crankshafts rotating in the same direction which may be either clockwise or counter-clockwise. The two crankshafts 34 and 42 are interconnected by a positive drive interconnection in the form of a flexible chain 44 engaging sprocket gears 46 and 48 in which the sprocket gear 46 connected to the crankshaft 34 is twice the diameter and has twice the number of teeth as the sprocket gear 48 engaged with the crankshaft 42 so that the angular velocity of the crankshaft 42 is always two times the angular velocity of the crankshaft 34. For subsequent identity in describing the "Zachery" cycle, the crankshaft, piston and related structure associated with the piston 24 and crankshaft 34 is designated as $w_1$ and the crankshaft 42 and the piston 26 and related structure will be designated as $w_2$.

Figure 5:
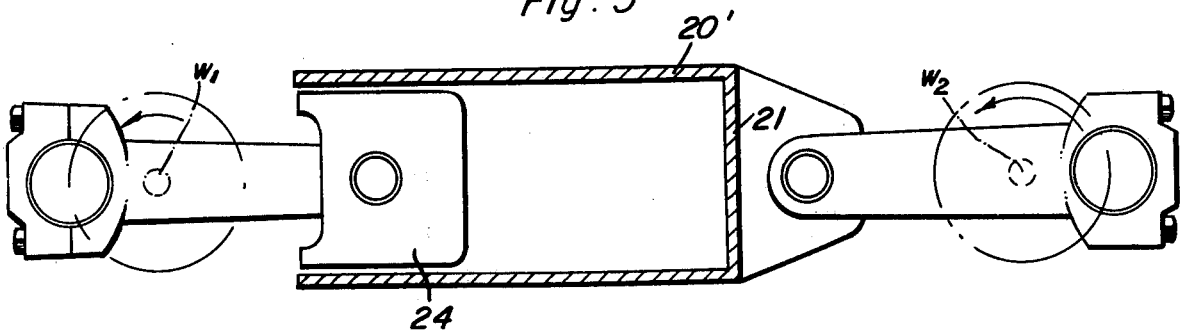
FIG. 5 is a schematic view of an alternative structure in which a closed end cylinder is substituted for the stationary cylinder and one of the pistons employed in FIGS. 1–3.

In the alternative structure illustrated in FIG. 5, the cylinder 20' is provided with a closed end 21 which structure combines to perform in the same manner as the piston 26 and its relationship to the cylinder in FIG. 1 with crankshaft $w_2$ being connected to the cylinder 20' so that it reciprocates in the same manner and angular relationship as the crankshaft $w_2$ in FIG. 1. The piston 24 in FIG. 5 reciprocates in the same manner as in FIG. 1 and is associated with the crankshaft $w_1$ in the same manner as in FIG. 1. It is pointed out that different positive gear connections of various arrangements and configurations can be used which would allow either opposite or same direction of rotation of the $w_1$ and $w_2$ crankshafts and in either case, the same cycle will result.

Figure 6:
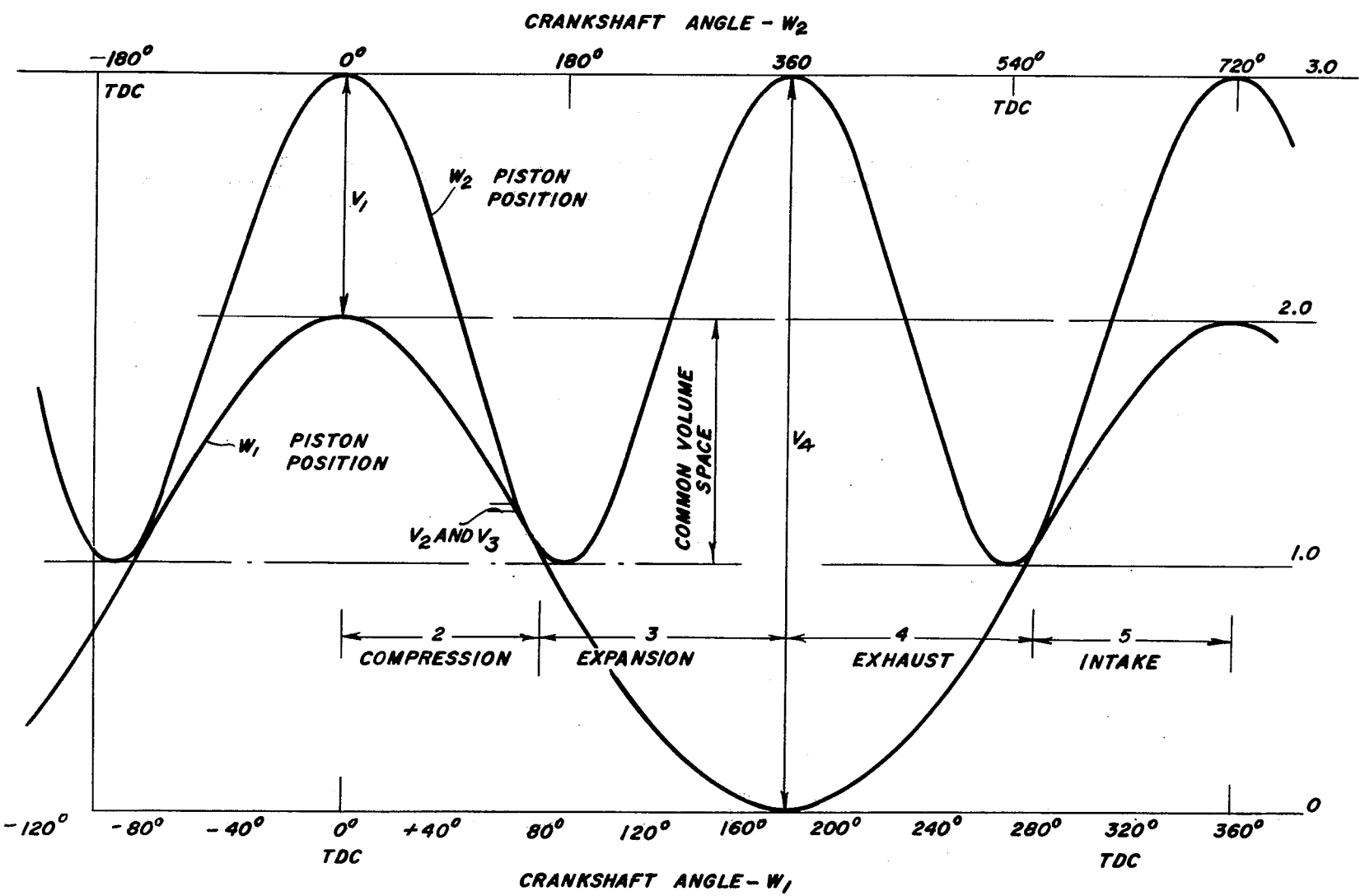
FIGS. 6, 6A–6D are diagrammatic illustrations of an example "Zachery" cycle including the piston, cylinder, crankshaft relationships and other characteristics of the cycle.

FIG. 6 illustrates diagrammatically the positions of the $w_1$ and $w_2$ piston phases within the common cylinder during an exemplary "Zachery" cycle. The $w_1$ crankshaft, either driving or driven by the $w_1$ piston, is phased with respect to the $w_2$ crankshaft, either driving or driven by the $w_2$ piston, is such that the $w_1$ piston is at its maximum penetration into the common cylinder at the same time that the $w_2$ piston is at its minimum penetration into the common cylinder at the beginning of the cycle. This position for $w_1$ crankshaft is designated 0° and this position for $w_2$ crankshaft is also designated 0° degrees with all other positions being referenced to this initial position and it is pointed out that for any rotations from this reference position, the number of degrees of rotation of $w_2$ crankshaft will always equal twice the number of degrees of rotation of $w_1$ crankshaft.

Figure 7:
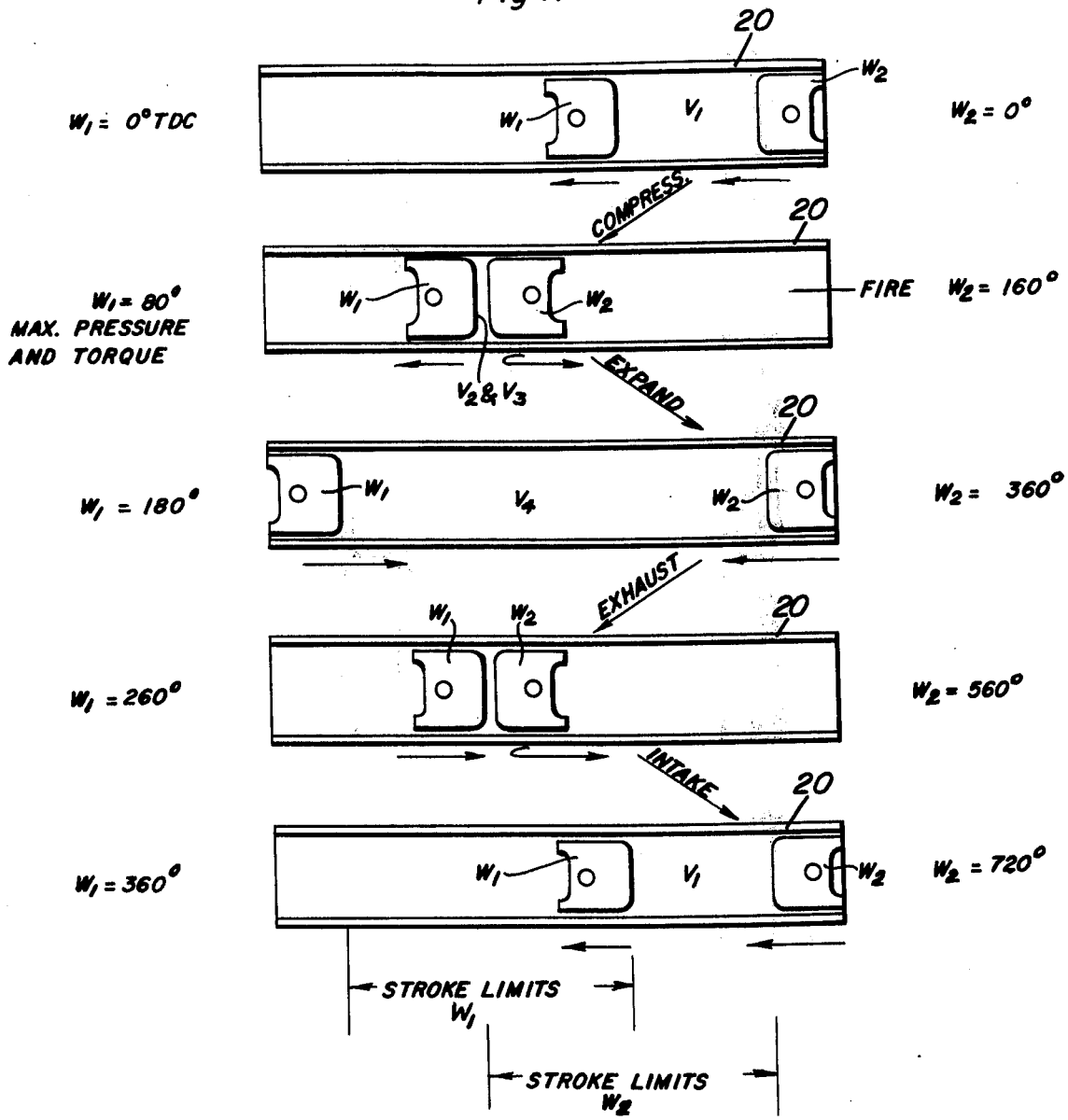
FIG. 7 is a group of schematic illustrations showing the different positions of the pistons in the "Zachery" cycle.

In the reference position, $w_1$ crankshaft = 0° and $w_2$ crankshaft = 0° and the cylinder volume $V_1$ is assumed to be filled with an air-fuel mixture at atmospheric pressure $P_1$ and ambient temperature $T_1$ and the exhaust and intake valves or ports are assumed to be closed. This arrangement is diagrammatically illustrated in FIG. 6 and schematically illustrated in the first illustration in FIG. 7.

Figure 6A:
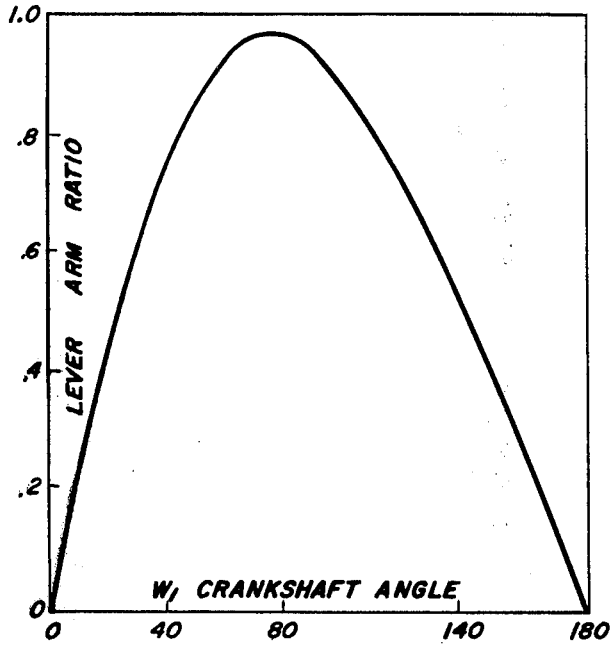

During the compression process, $w_1$ crankshaft rotates from 0° to 80° while $w_2$ crankshaft rotates from 0° to 160°. The air-fuel mixture has been compressed to its minimum volume $V_2$ at pressure $P_2$ and temperature $T_2$ and at this point, the air-fuel mixture is ingited and burns raising the pressure to $P_3$ and temperature to $T_3$ when assuming $V_2$ is equal to $V_3$ during the combustion process which assumes a constant volume heat injection process with the $w_1$ crankshaft being near its maximum lever arm position as illustrated in FIG. 6A.

In the power or expansion process, $w_1$ crankshaft rotates from 80° to 180° while $w_2$ crankshaft rotates from 160° to 360°. The cylinder volume increases to $V_4$ at pressure $P_4$ and temperature $T_4$ and in this example, $V_4$ is approximately three times $V_1$.

In the exhaust process, $w_1$ crankshaft rotates from 180° to 280° while $w_2$ crankshaft rotates from 360° to 560° with the exhaust valve or port opening from the time that $w_1$ crankshaft = 180° until $w_1$ crankshaft = 280° at which time it closes and the products of combustion have been exhausted.

During the intake process, $w_1$ crankshaft rotates from 280° to 360° while $w_2$ crankshaft rotates from 560° to 720° with the intake valve or port opening from $w_1$ crankshaft position = 280° until $w_1$ crankshaft = 360° at which time it closes.

One of the significant factors in this cycle in an internal combustion engine is the unique ability to compress an initial intake volume $V_1$ to a compressed volume $V_2$ at which time heat is added through the combustion process and then expand the volume to $V_4$, a much larger volume than $V_1$, thereby converting a greater percentage of the heat injected into shaft work, or conversely, rejecting a lesser percentage of the heat injected in exhaust gases than can be converted into shaft work by a conventional internal combustion engine of the same intake volume and compression ratio. This provides a substantially greater thermal efficiency for the "Zachery" cycle engine for any given intake volume and compression ratio than for a conventional engine using the Otto cycle or Diesel cycle.

In comparing the air standard Otto cycle to the air standard "Zachery" cycle, the Otto cycle will yield a thermal efficiency of about 60% when the compression ratio is 10:1 whereas the "Zachery" cycle will yield a thermal efficiency of about 77% for a air standard "Zachery" cycle with the same compression ratio. This large difference in thermal efficiency is accounted for simple by the additional expansion of the gas during the "Zachery" cycle made possible by the relationship of the crankshafts and pistons. Data taken from actual thermodynamic charts using the ideal air-fuel ratio for octane show that the Otto cycle engine has a thermal efficiency of about 44% for a 10:1 compression ratio whereas the example "Zachery" cycle engine will yield a thermal efficiency of about 63% for this compression ratio. In acutal operating conditions heat losses in engines (other than losses in the exhaust gases due to the restricted expansion of the conventional Otto cycle engine) are encountered together with further reductions due to non-constant volume burning and other factors generally reduce the actual realized thermal efficiency by approximately 20% of the ideal value. Assuming this 20% loss applies to both the Otto cycle engine and the "Zachery" cycle engine, the Otto cycle engine in actual practice will yield a thermal efficiency of about 35% whereas the actual thermal efficiency yield of the "Zachery" cycle engine is about 50% thus indicating that the conventional Otto cycle engine will consume about 43% more fuel than the example "Zachery" cycle engine for the same intake volume, compression ratio and power output. It is pointed out that the efficiency of the "Zachery" cycle engine can be increased or decreased for any given compression ratio by properly choosing and combining the ratio of the crankpin offsets of the $w_1$ and $w_2$ crankshafts, thereby determining the respective strokes of the $w_1$ and $w_2$ pistons, and by properly choosing the displacement of the $w_1$ and $w_2$ crankshaft centers and the phasing of the $w_1$ and $w_2$ crankshafts with respect to each other. These choices can increase the expansion ratio $V_4/V_2$ yielding an increase in thermal efficiency or another choice can decrease the expansion ratio $V_4/V_2$ yielding a decrease in thermal efficiency.

It is pointed out that expansion down to atmospheric pressure and below can be obtained by proper choices. Also, the maximum pressure in the "Zachery" cycle engine appears near the maximum lever arm position of the $w_1$ crankshaft and near the minimum lever arm position of the $w_2$ crankshaft thus yielding a higher peak torque than the conventional Otto cycle engine since the maximum pressure in the Otto cycle engine occurs near the minimum lever arm position of its crankshaft. In addition, it should be noted that by properly phasing and displacing the $w_1$ and $w_2$ crankshafts, the cylinder volume can be completely swept of all exhaust gases while still maintaining the desired compression ratio. Since more heat is converted to shaft work in the "Zachery" cycle engine than in the conventional Otto cycle engine, the average temperature is lower for the same heat input and therefore the thermal stresses and heat dissipation requirements are lower in the "Zachery" cycle engine.

Further, the exhaust temperature of the combustion products are lower in the "Zachery" cycle engine than in the conventional Otto cycle engine thus contributing less heat pollution to the atmosphere and the lower exhaust temperature will in all probability reduce the ratio of other pollutants in the exhaust gases.

The above mentioned differences and advantages of the "Zachery" cycle engine as compared with the conventional Otto cycle engine apply equally well when compared to the standard Diesel cycle engine or to the dual combustion diesel cycle. The standard Diesel cycle, which approximates a constant pressure combustion process, will yield a lower thermal efficiency than the standard Otto cycle, which approximates a constant volume combustion process, for the same intake volume and compression ratio. The thermal efficiency of Diesel cycle engines and Otto cycle engines as well as the "Zachery" cycle engine is inherently a function of the compression ratio since this ratio determines the average temperature at which heat is injected into the system. The thermal efficiency of these engines is also inherently a function of their respective expansion ratios, since the expansion ratio determines the average temperature at which heat is rejected from the system. Since the expansion ratio of the "Zachery" cycle is always a multiple of the compression ratio and the expansion ratios of the Otto cycle or Diesel cycle are always equal to or less than the compression ratio, it follows that the thermal efficiency of the "Zachery" cycle will always be greater than that of the Otto cycle or Diesel cycle for any given compression ratio. The "Zachery" cycle engine can also be used in a Diesel-like cycle, that is, compressing air from $V_1$ to $V_2$ then injecting liquid fuel so as to burn in an approximate constant pressure process, followed by an expansion to $V_4$. Since higher compression ratios may be used in a Diesel-like cycle, comparable higher thermal efficiencies can be obtained using the "Zachery" cycle engine in a diesel-like cycle than can be obtained in a standard Diesel cycle of the same compression ratio.

Figure 8:
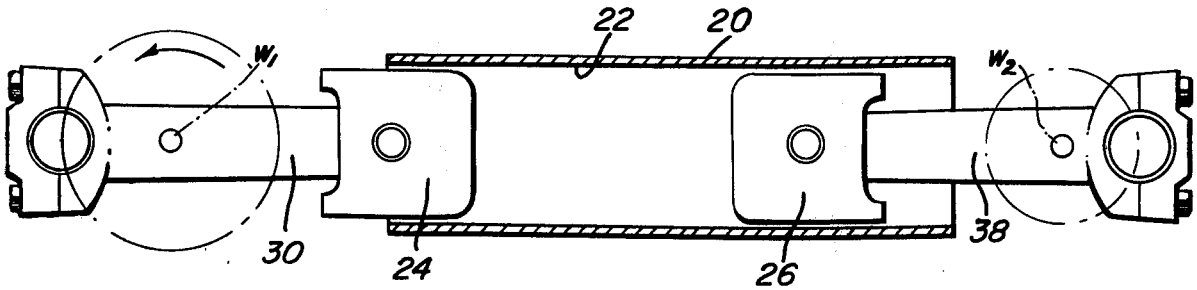
FIG. 8 is a schematic view of an engine utilizing an unequal stroke system and a phasing that allows a more complete exhaust of the volume.
Figure 10:
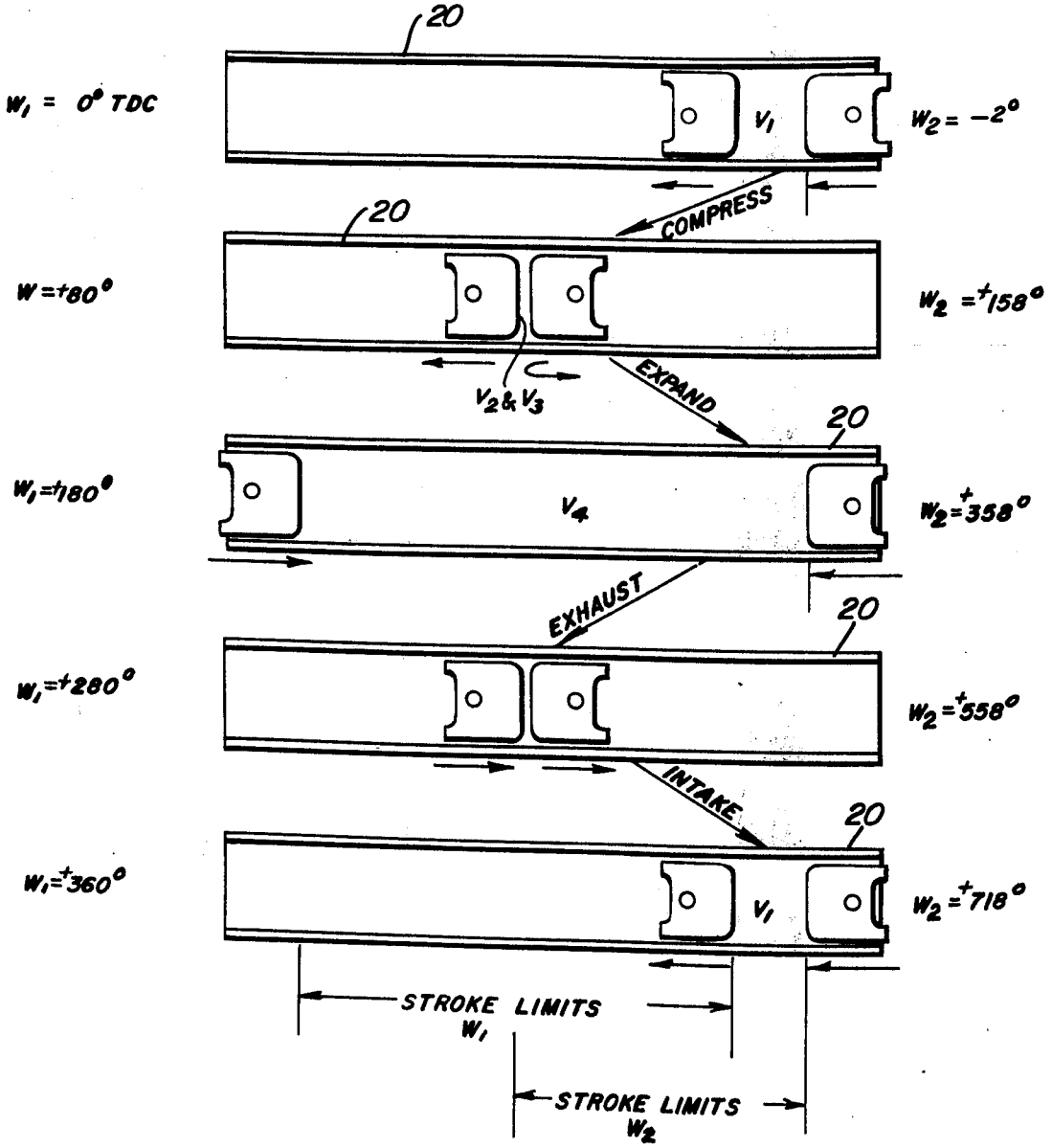
FIG. 10 is a group of schematic illustrations similar to FIG. 7 but illustrating the unequal stroke system.
Figure 9:
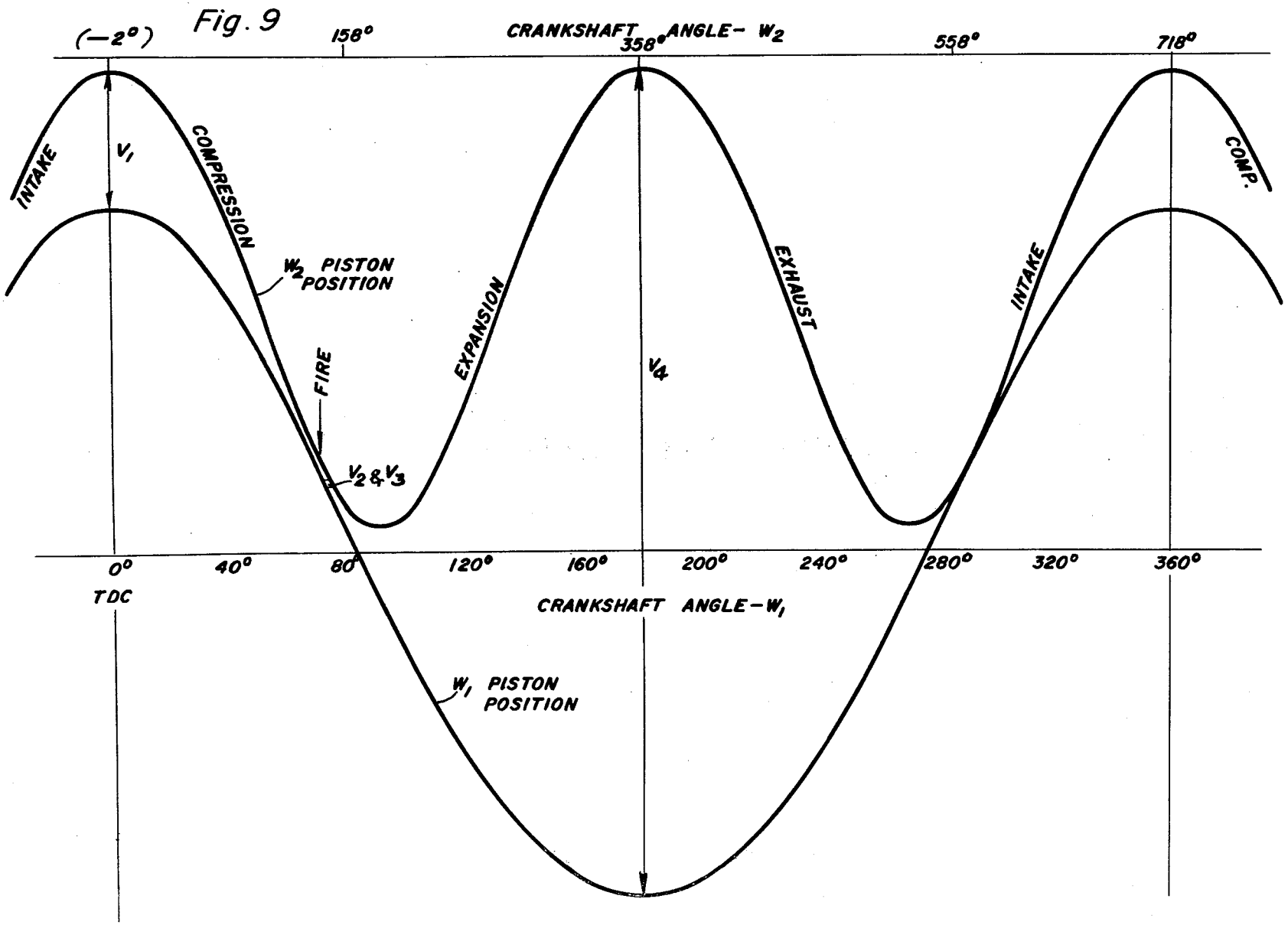
FIG. 9 is a diagrammatic indication of the cycle corresponding with the unequal stroke system illustrated in FIG. 8.

FIGS. 8, 9 and 10 illustrate schematically the "Zachery" cycle employed in a power device in which unequal piston strokes are employed with corresponding reference numerals being employed and with the stroke ratio of $w_1/w_2$ being 3:2 and the phase displacement being 2°, that is, the crankshaft angle of $w_2$ is at minus 2° when the crankshaft angle of $w_1$ is at 0°. This phase relationship and the movement of the $w_1$ and $w_2$ pistons and the crankshaft degree relationships are illustrated in FIG. 9 and the schematic orientation of the pistons are illustrated in FIG. 10. In this arrangement, the compression ratio is 10:1, the expansion ratio is about 60:1 and the exhaust clean-out is approximately 100%.

Figure 11:
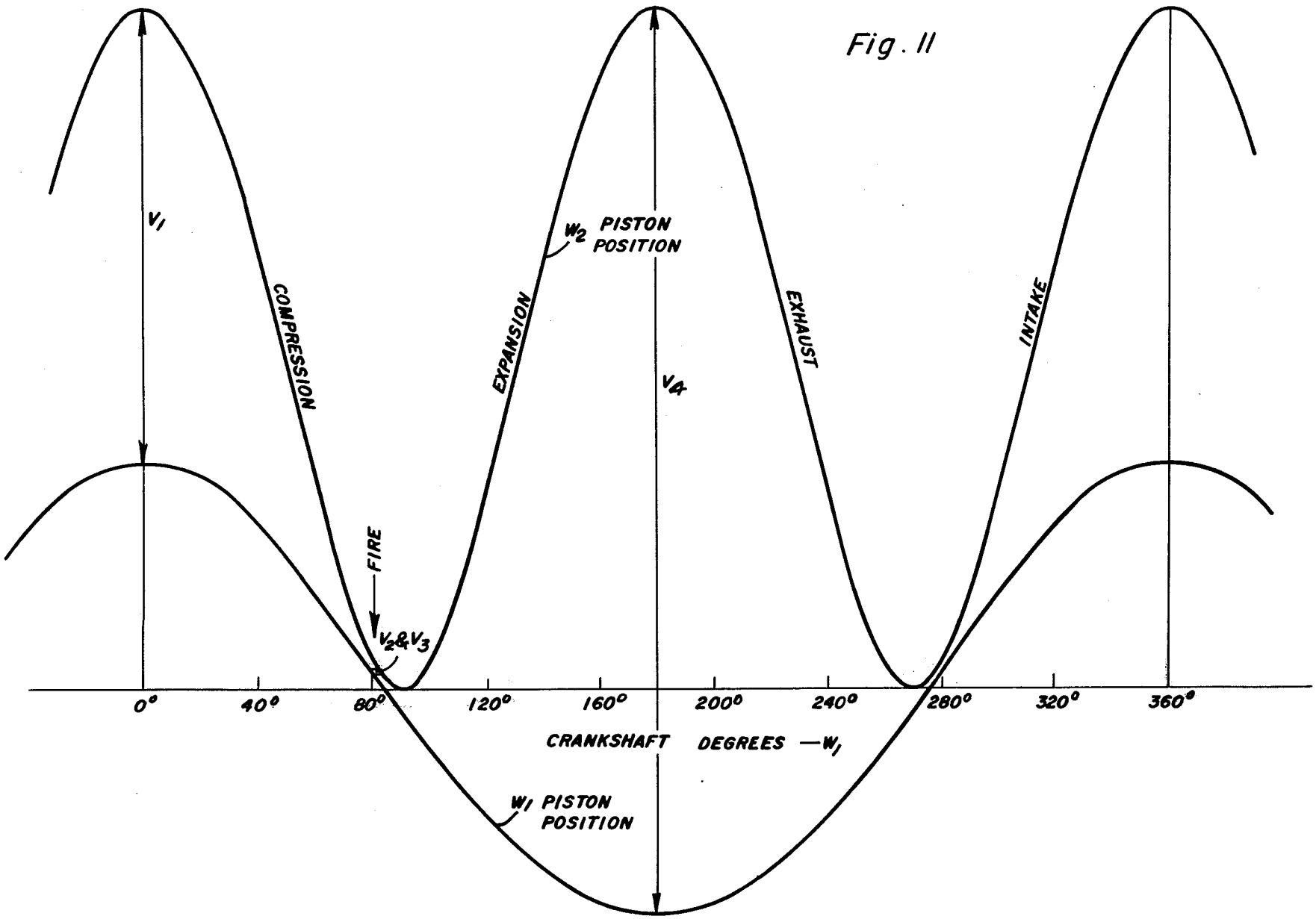
FIG. 11 is a diagrammatic indication of the cycle illustrating a different stroke ratio, compression ratio and expansion ratio.

FIG. 11 illustrates another variation of the "Zachery" cycle in which the stroke ratio $w_1/w_2$ is 2:3, the compression ratio is 32:1 and the expansion ratio is 64:1.

Figure 6D:
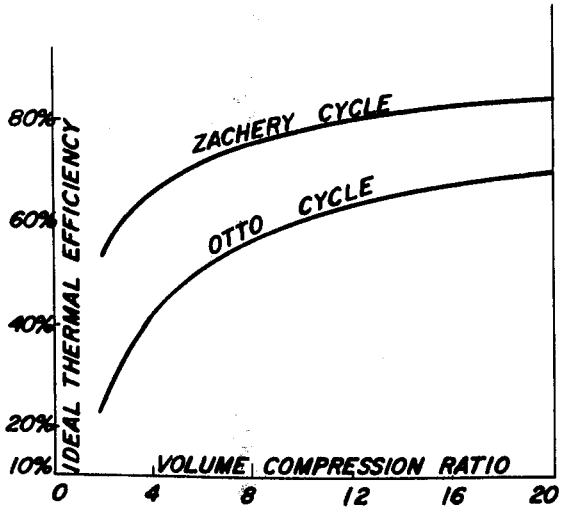
Figure 6B:
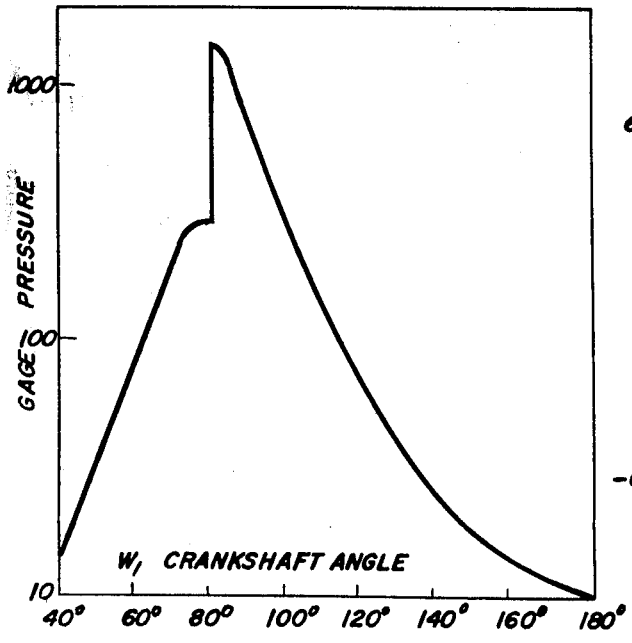
Figure 6C:
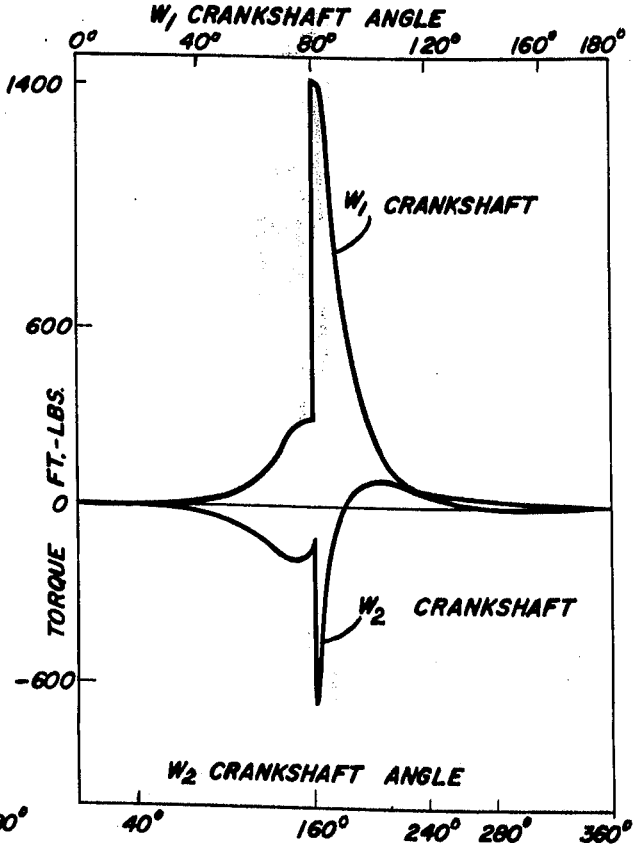

As illustrated in the diagrammatic views, FIG. 6D illustrates the increased thermal efficiency of the "Zachery" cycle as compared with the Otto cycle and the "Zachery" cycle obtains maximum peak torque due to the coincidental occurrence of maximum lever arm and maximum pressure as illustrated in FIGS. 6A, 6B and 6C. The increase in thermal efficiency of the "Zachery" cycle is a result of the substantial overlap of the piston strokes which is actually approximately 41% of the stroke for the equal stroke configuration if a clearance of 25 hundredths inches is retained at the point of closest approach. Whether the equal stroke system is used or the unequal stroke system or ratio is used, the phasing of the pistons is such that the maximum and minimum penetration or displacement of the $w_1$ piston always occurs near the minimum penetration of the $w_2$ piston into the cylinder. This arrangement enables the great amount of overlap necessary to achieve the expansion required for a substantial increase in thermal efficiency. By comparison with the device disclosed in the aforementioned Mallory patent, the previously patented device has an overlap or commonly used space, of approximately 5% of the stroke length for the equal stroke system and less for the unequal stroke systems whereas the specific phase relationship in the "Zachery" cycle provides an overlap of approximately 41% for the equal stroke arrangement and substantially comparable overlaps for other stroke ratio arrangements. In further comparison with the Mallory device, the slow speed crankshaft in the Mallory device is not at the maximum lever arm position at the point of closest approach of the pistons whereas the "Zachery" cycle is at about 95% of the available lever arm position since the $w_1$ crankshaft is about 80° into its cycle at the point of closest approach of the pistons whereas in Mallory, the slow speed crankshaft is about 37° into its cycle at the point of closest approach. In the Mallory device, the volume has expanded to about 50% of its expansion volume before the maximum lever arm is reached and as a consequence, the pressure is drastically decreased at this point and as a consequence, the peak torque is drastically reduced whereas in the "Zachery" cycle, maximum pressure occurs at the maximum lever arm thereby providing maximum peak torque.

Further, as Mallory states, the speed of both pistons is approximately the same at the point of closest approach in U.S. Pat. No. 2,486,185 whereas in the "Zachery" cycle the slow piston is near its maximum velocity and the fast piston is near its minimum velocity at the point of closest approach. Moreover, in U.S. Pat. No. 2,486,185 supercharging is essential in at least one configuration and probably necessary in others, whereas in the "Zachery" cycle supercharging is not essential or even desired, except for special applications, since supercharging requires a reduction in the maximum compression ratio that may be allowed for any given fuel and a consequent serious reduction in thermal efficiency. In addition, the "Zachery" cycle may be phased such that the point of closest approach occurs near the end of the exhaust portion of the cycle thereby affording a more complete exhaustion of the volume.

The foregoing is considered as illustrative only of the principles of the invention. Further, since numerous modification and changes will readily occur to those skilled in the art, it is not desired to limit the invention to the exact construction and operation shown and described, and accordingly all suitable modifications and equivalents and multiple cylinder combinations may be resorted to, falling within the scope of the invention.

What is claimed as new is as follows:

1. A compression-expansion power device comprising a chamber of predetermined volume defined by an enclosing structure adapted to receive and exhaust a compressible fluid, said structure including opposed portions movable relative to each other and occupying common spaces over the entire space of the chamber at predetermined, non-simultaneous intervals thereby enabling predetermined changes in the volume of the chamber between the opposed portions at different relative positions thereof, said commonly occupied space in the chamber constituting a substantial portion of the volume defined by the enclosing structure, said chamber being defined by an open-ended cylinder and the opposed portions include a pair of pistions reciprocally disposed in said cylinder, and means reciprocating said pistons whereby a substantial portion of the inner portions of the piston strokes overlap with only one piston disposed in the overlapping portion of the strokes at any particular time, said means reciprocating said pistons including a crankshaft associated with each of the pistons, each of the crankshafts having a crank arm thereon defining a variable length lever arm connected with its respective piston by a connecting rod, said crankshafts being interconnected for rotation at a predetermined ratio for cyclic movement of the pistons in the cylinder to define an intake process, a compression process, an expansion process and an exhaust process, said crankshafts rotating at a ratio of 2:1 whereby one of the pistons reciprocates at twice the frequency of the other piston, said pistons and crankshafts being so phased that, at the beginning of the cycle, the slower moving piston is at its maximum penetration into the common cylinder while the faster moving piston is at its minimum penetration position in the common cylinder and during the compression process, the slower moving piston and crankshaft move from 0° to 80° while the faster moving piston and crankshaft moves from 0° to 160°, during the expansion process, the slower moving piston and crankshaft moves from 80° to 180° while the faster moving piston and crankshaft moves from 160° to 360°, during the exhaust process, the slower moving piston and crankshaft moves from 180° to 280° while the faster moving piston and crankshaft moves from 360° to 560° and during the intake process, the slower moving piston and crankshaft moves from 280° to 360° while the faster moving piston and crankshaft moves from 560° to 720° thus completing the cycle, such arrangement being the nominal operation and phasing of the device.

2. The structure as defined in claim 1 wherein maximum pressure between the pistons occurs near the maximum lever arm position of the slower crankshaft and near the minimum lever arm position of the faster crankshaft.

3. The structure as defined in claim 2 wherein variation in the selection of the stroke ratio of the pistons and variation in the selection of the phase displacement and center displacement of the crankshafts in relation to each other enables different compression ratios, expansion ratios, peak torques and thermal efficiencies of the device.

4. The structure as defined in claim 3 wherein the phasing of the crankshafts is such that the point of minimum volume occurs near the end of the exhaust portion of the cycle thereby enabling a more complete exhaust of the volume as compared to variable volume devices wherein the point of minimum volume occurs near the end of the compression portion of the cycle.

5. A compression-expansion device comprising an open-ended cylinder adapted to receive and exhaust a compressible fluid, a pair of opposed pistons reciprocal in the cylinder, a crankshaft disposed outwardly of each end of the cylinder and being operatively connected to its respective piston by a connecting rod and crank arm defining a variable length lever arm during rotation of the crankshaft, means interconnecting the crankshafts so that the crankshafts will rotate at a predetermined ratio and phased so that one of the pistons is near its maximum penetration of the cylinder while the other of the pistons is near its minimum penetration of the cylinder at the beginning of a cycle of movement with the two pistons in the cylinder occupying a common space within the cylinder which constitutes a substantial portion of the volume of the cylinder with such common occupancy occurring at different intervals thereby preventing mechanical interference between the pistons, said shafts being rotatable at a ratio of 2:1 with the slower rotating shaft and its connected piston having maximum penetration into the cylinder at the beginning of the cycle and the faster crankshaft and piston having minimum penetration in the cylinder at the beginning of the cycle whereby compression of the fluid in the cylinder occurs as the slower piston moves outwardly to a crankshaft angle of approximately 80° while the faster moving piston moves inwardly to an angular position of the crankshaft of approximately 160° whereby peak pressure and torque is exerted on the slower moving piston and crankshaft at a maximum lever arm position thereof and maximum pressure and torque is exerted on the faster moving piston and crankshaft at a minimum lever arm position and expansion of the volume between the pistons occurring when the slower moving piston and crankshaft moves from approximately 80° to 180° and the faster moving piston and crankshaft moves from approximately 160° to 360° and exhaust of the volume between the pistons occurs when the slower moving piston and crankshaft moves from 180° to 280° while the faster moving piston and crankshaft moves from 360° to 560° and intake into the volume occurring when the slower moving piston and crankshaft moves from 280° to 360° and the faster moving piston and crankshaft moves from 560° to 720° thereby completing the cycle.

* * * * *